United States Patent [19]

Canevari

[11] Patent Number: 4,628,160

[45] Date of Patent: Dec. 9, 1986

[54] ELECTRICAL TILT SWITCH

[75] Inventor: Ronald D. Canevari, Panorama City, Calif.

[73] Assignee: Allied Corporation, Morristown, N.J.

[21] Appl. No.: 791,829

[22] Filed: Oct. 28, 1985

[51] Int. Cl.[4] ..... H01H 35/14

[52] U.S. Cl. ..... 200/61.45 R; 200/61.52; 200/DIG. 29

[58] Field of Search ..... 200/61.45 R, 61.52, 200/DIG. 29, 61.83, 266–269

[56] References Cited

U.S. PATENT DOCUMENTS

| | | | |
|---|---|---|---|
| 1,662,979 | 3/1928 | Nelson | 200/61.52 |
| 1,915,267 | 6/1933 | Bigelow | 200/61.52 |
| 2,365,262 | 12/1944 | Gair | 200/61.52 |
| 2,414,463 | 1/1947 | Gunn et al. | 200/268 |
| 2,892,049 | 6/1959 | Rubinstein | 200/61.52 X |
| 3,752,945 | 8/1973 | Achterberg | 200/61.52 X |
| 3,831,163 | 8/1974 | Byers | 200/61.45 R X |
| 4,001,185 | 1/1977 | Mitsui et al. | 200/61.45 R |
| 4,042,796 | 8/1977 | Zink | 200/61.52 X |
| 4,297,683 | 10/1981 | Roberts | 200/61.52 X |
| 4,513,183 | 4/1985 | Hill | 200/61.45 R |

FOREIGN PATENT DOCUMENTS

| | | | |
|---|---|---|---|
| 1322964 | 4/1963 | France | 200/61.52 |

*Primary Examiner*—J. R. Scott

*Attorney, Agent, or Firm*—Robert C. Smith; Vett Parsigian

[57] ABSTRACT

An electrical tilt switch includes a generally cylindrical cap member having a hollow interior with an internal inwardly extending ridge positioned a significant distance above its lower edge, a flat, generally cylindrical base member having a concave dished upper face, an annular insulating member interposed between the base and cap and fastened to each, electrical leads attached to the base and cap members, and a spherical contact member carried on the dished surface and movable against the ridge when the switch is tilted to a specified angle. For severe environmental conditions the preferred material for the cap, base and spherical contact member is a K Monel alloy.

4 Claims, 2 Drawing Figures

ELECTRICAL TILT SWITCH

This invention relates to electrical switches and particularly to a switch responsive to being oriented at an angle to close an electrical circuit.

An electrical switch normally consists of, at the minimum, a pair of electrical contacts and moveable means for making and breaking electrical continuity between said contacts. An electrical tilt switch responds to being physically moved from one position to another to close a circuit which was normally open or vice versa. A typical mercury switch used in lighting circuits consists of a glass bulb with electrical contacts connected thereto so that when the bulb is tilted in one direction, a bead of liquid mercury rolls to one end and closes a circuit between two contacts and when tilted the opposite way, the mercury rolls away from the contacts and the circuit is opened. Such a switch is operable in only one plane. Similar switches are used in thermostats, humidistats, etc. There are also electrical inclinometers which measure tilt or incline from a reference position on an analog basis and can be arranged to give a signal when the tilt reaches any desired level. these also operate in one plane only. Combinations of such mechanisms can, of course, be arranged to sense a tilt or incline in more planes but would become cumbersome when use to sense angular motion around many planes.

Applicant has had a requirement for a switch that will sense tilt exceeding a given amount away from vertical in any direction, which is extremely rugged and simple to mechanize, which is quite small and can be soldered to a printed circuit board, which is non-magnetic so as not to interfere with a nearby compass, which operates over a relatively wide range of operating temperatures, is moisture resistant, and will withstand considerable shock and vibration without damage. In addition to the above, the switch must operate in a very caustic, hydrogen-rich environment. A diligent search among commercially available switch mechanisms failed to find a tilt switch meeting applicant's reuqirements. A considerable effort was expended to design a satisfactory tilt switch but those showing promise prior to developing the present switch turned out to be inadequate. A serious problem area resides in the requirement to make assured contact over time and under all conditions. With at least one design the surface corrosion tended to cause excessive contact resistance. When the parts were gold plated to avoid corrosion, the switch would not withstand required shock and vibration tests because the gold plating tended to chip or flake away as a result of the tremendous number of switch openings and closings.

The tilt switch of the present invention is characterized in that it includes a generally cylindrical cap member which has a hollow interior and a convex ridge extending around its interior surface near its top, a base member which is in the form of a flat cylinder with an upper surface which is dished to form a smooth concave surface, a cylindrical insulating member interposed between the cap and the base, electrical leads fastened to the cap and base, and a spherical contact member moveable in the chamber formed between the cap and base. This contact member makes contact only with the base when the switch is positioned vertically (with respect to an axis through the cap and base), but rolls in any direction toward the sidewall of the cap as the switch is tilted and at some desired angle makes contact with the internal convex ridge to close a circuit. The cap, base and spherical contact members are formed of a K Monel material which has excellent structural properties and corrosion resistance, hence low surface resistivity which provides excellent electrical contact.

No damage or even significant deterioration were experienced from extensive shock and vibration testing. During such testing the spherical ball would make contact innumerable times with the convex ridge, but the performance varied only slightly and the hysteresis or dead band (the difference in tilt angle between making contact and breaking contact,) remained substantially the same. Applicant has thus provided a tilt switch having the desirable properties enumerated above, simple rugged design, consistent operation over time and over 360 degrees of movement, freedom from corrosion problems despite a hostile environment, small size and being of non-magnetic material.

The invention will now be described with reference to the accompanying drawing in which.

Figure 1:
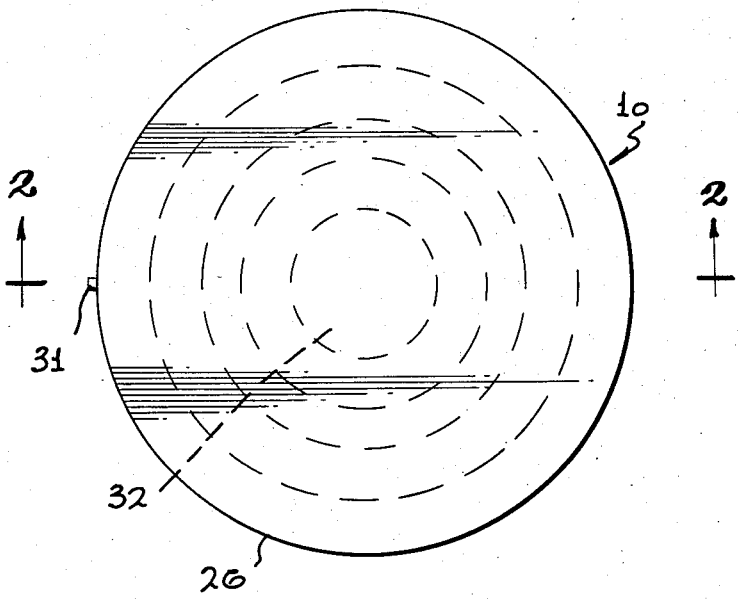
FIG. 1 is a plan view of an electrical tilt switch incorporating may invention.
Figure 2:
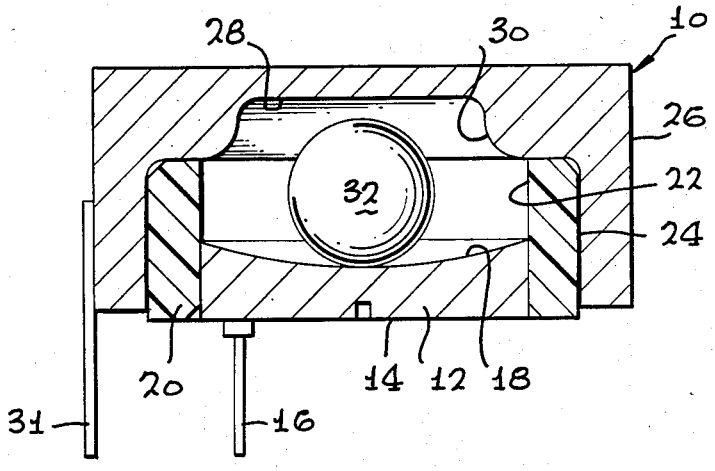
FIG. 2 is a cross-sectional drawing taken along line 2—2 of FIG. 1.

Referring now to FIGS. 1 and 2, the switch shown generally at numeral 10 comprises a base 12 which is in the form of a flat cylindrical member having a cylindrical side wall, a flat bottom 14 to which is attached an electrical lead 16 and a dished top surface 18 which is a concave surface whose curvature is selected, in combination with certain other dimensions discussed below, to give the desired response angle. Surrounding and attached to the base 12 is an annular insulating member 20 whose internal and external sidewalls, 22 and 24 respectively, are taller than the sidewall of base member 12. This insulating member is preferably formed of a glass reinforced nylon. Surrounding and covering the base 12 and insulating member 20 is a cylindrical cap 26 having an internal sidewall of slightly less height than the height of member 20, a flat internal top surface 28 extending from the center (axis) a substantial distance toward the sidewall and a convex ridge 30 extending radially inwardly from the top of the internal sidewall and curving in a generally "S" shaped contour upwardly to intersect with the top surface. An electrical lead 31 is attached to the cylindrical exterior wall of cap 26. Supported on the concave surface 18 is a spherical contact member or ball 32 which assumes the position shown when maintained in a vertical attitude and which will tend to roll downhill in whatever direction happens to be downhill at the time. When the tilt reaches a desired angle, such as 10 degrees or more the ball 32 will roll into contact with the convex ridge 30 closing an electrical circuit between base 12 and cap 26. This contact will remain until the switch is moved to some lesser amount of tilt such as, for example, 8.5 degrees from the vertical, at which time the base 32 will roll away from ridge 30 and contact between members 12 and 26 will be broken.

The external wall 24 of insulating member 12 is chamfered at the top to accommodate the inside curve or fillet at the top of the inner sidewall of cap 26. As stated, this inner sidewall is of slightly less height than the height of insulating member 20 which spaces cap 26 from a printed circuit board (not shown) to which base 12 and insulating member 20 may be attached. This spacing may be determined, at least in part, by the voltage level of the circuit which is being controlled since cap 26 must be prevented from shorting to any conductor tracks which might happen to be on the board to which the base 12 is attached. Alternatively, the conductor tracks may be arranged so that those making contact with base 12 are insulated from those contacting cap 26, in which case the spacing described above would not be required. The switch described herein operates in a range of approximately 5 volts and is effective at least to 28 volts d.c.

As described above, the annular insulting member 20 is formed of glass reinforced nylon. Base 12, cap 26 and spherical contact member 32 are all formed of a K Monel alloy, specifically Monel K500. This alloy has the required physical strength in that it is not significantly deformed by a very large number of repeated contacts between ball 32 and the convex ridge 30. It also withstands the very corrosive environment for which the above described switch was designed and does not develop a high surface resistance. Ball 32 is a commercially available ball bearing of Monel K500. Should a similar switch be required for use in a less hostile environment and where a severe vibration and shock test is not required, parts 12, 26 and 32 could also be of brass. Those skilled in the art will readily think of additional materials useful for less severe applications.

The factors which affect the angle of tilt at which the switch contacts close are the radius of the dished surface of base 12, the diameter of ball 32, and the distance from the axis of the housing to the point of contact with the convex ridge 30. By proper selection of these dimensions the switch can be made to close at different desired angles of tilt. The ridge 30 will normally be spaced inwardly from the internal sidewall of cap 26 a distance just sufficient to assure that the ball 32 makes contact first with ridge 30 and not with insulating member 20. Applicant's switch, which is designed to close at approximately 10 degrees from the vertical is 0.69 inch in diameter, 0.33 inch high, the dished surface at the top of base 12 is formed to a radius of 0.75 inch and the ball 32 is 0.1875 inch diameter.

I claim:

1. An electrical tilt switch including a pair of electrical contacts and moveable means for making and breaking electrical continuity between said contacts, characterized in that said switch comprises a generally cylindrical cap member having a ridge extending internally of its internal sidewall and spaced a significant distance from its bottom edge such that said sidewall extends only a part of the height of said cap member, the internal top surface of said cap extends only a part of the distance from its center toward said internal sidewall, and a radially inwardly extending surface extends from said internal sidewall, said ridge being form in a generally "S" shaped convex surface from said top surface to said radially inwardly extending surface, a generally cylindrical base having an upper face having a smooth concave dished surface, an annular insulating member of generally cylindrical shape having an internal surface fastened to said base member and an external surface fastened to the internal sidewall of said cap member, electrical leads attached to said cap and base members, and a spherical contact member carried on said concave dished surface and moveable against said ridge when said switch is tilted from the vertical by a specified amount, thereby closing said switch.

2. An electrical tilt switch as claimed in claim 1 wherein said cap, base, and spherical contact members are all formed of a K Monel alloy.

3. An electrical tilt switch as claimed in claim 1 wherein the internal sidewall of said cap member is somewhat shorter than the height of said insulating member such that said cap member will not make contact with a flat surface supporting said base.

4. An electric tilt switch including a pair of electrical contacts and moveable means for making and breaking electrical continuity between said contacts, characterized in that said switch comprises a first member consisting of generally cylindrical cap member having an internal wall with a straight cylindrical surface over a substantial part of its height, a radially inwardly extending surfaces at the top of said straight sides, and internal flat top extending from the center of said cap member radially outwardly a significant distance toward said straight cylindrical surface, and a convex surface tapering in a generally "S" shaped cross section from said flat top to said inwardly extending surface forming a generally annular ridge, and a first electrical lead connected to said member;

a second member comprising a base having a flat bottom, a generally cylindrical sidewall, a top having a smooth concave dished surface, and a second electrical lead connected to said second member a third generally cylindrical insulator member of height slightly greater than the height of said straight cylindrical surface and having an outside diameter just less than the diameter of said cylindrical surface and an inside diameter such that it telescopes over the cylindrical sidewall of said second member, said insulator member being fastened to said cylindrical sidewall and to said straight cylindrical surface;

a spherical contact member carried on said second member and movable over said concave surface, said spherical contact member being of a diameter such that when said switch is tilted a specified amount, said spherical contact member is moved toward the outside edge of said second member and comes into contact with said convex surface, thereby closing an electrical circuit between said first and second members, said first and second members and said spherical contact member all being formed of a "K" Monel alloy.

* * * * *